United States Patent [19]

Van Malderghem et al.

[11] 4,306,711

[45] Dec. 22, 1981

[54] DECOLLATING MACHINE AND APPARATUS

[75] Inventors: Edmund G. Van Malderghem, Lewiston; Elmer G. Schultz, Sanborn, both of N.Y.

[73] Assignee: Moore Business Forms, Inc., Grand Island, N.Y.

[21] Appl. No.: 155,603

[22] Filed: Jun. 2, 1980

Related U.S. Application Data

[63] Continuation of Ser. No. 944,367, Sep. 21, 1978, abandoned.

[51] Int. Cl.[3] ..... B65H 41/00

[52] U.S. Cl. ..... 270/52.5; 225/3; 225/5; 225/100

[58] Field of Search ..... 270/52.5; 433/409-412; 225/3, 5, 100

[56] References Cited

U.S. PATENT DOCUMENTS

| | | | |
|---|---|---|---|
| 2,135,364 | 11/1938 | Templeton | 270/52.5 |
| 2,237,320 | 4/1941 | Spayd et al. | 225/3 |
| 2,252,702 | 8/1941 | Metzner | 225/5 |
| 2,328,582 | 9/1943 | Ratchford et al. | 225/5 |
| 2,513,093 | 6/1950 | Hageman | 225/100 |
| 3,079,142 | 2/1963 | Pine | 270/52.5 |
| 3,514,094 | 5/1970 | Absler | 270/52.5 X |
| 3,857,557 | 12/1974 | Gill | 270/52.5 |
| 3,944,206 | 3/1976 | Bower | 270/52.5 X |
| 4,018,431 | 4/1977 | Schueler | 270/52.5 |

*Primary Examiner*—Clifford D. Crowder

*Assistant Examiner*—S. Heinz

*Attorney, Agent, or Firm*—Allegretti, Newitt, Witcoff & McAndrews

[57] ABSTRACT

An improved machine and apparatus are disclosed for assisting in decollating or separating the separable parts of a multi-part, carbonless, manifold, continuous web business forms assembly having integral "locks" incorporated therein that are utilized to hold the parts of the continuous web business forms assembly in alignment when the continuous web business forms assembly is used on high speed printing device. The improved machine has a plurality of decollating stations arranged in series, and each station includes a refold roller. The part of the continuous web business forms assembly being separated at a decollating station passes about and contacts the refold roller. The improved apparatus is mounted on the machine and includes an axle having two or three wheels rotatably mounted therein, with the first, relatively small diameter wheel being in contact with and driven by the refold roller, with the second and third wheels being in contact with the separated part of the continuous web business forms assembly as it passes around the refold roller, and with the first, second and third wheels being interconnected so that they rotate together and so that as a result of the difference in the speeds of the peripheral surfaces of the wheels, the second and third wheels impart a separating force to the separated part of the continuous web business forms assembly to assist in breaking the "locks" in the business forms assembly.

35 Claims, 11 Drawing Figures

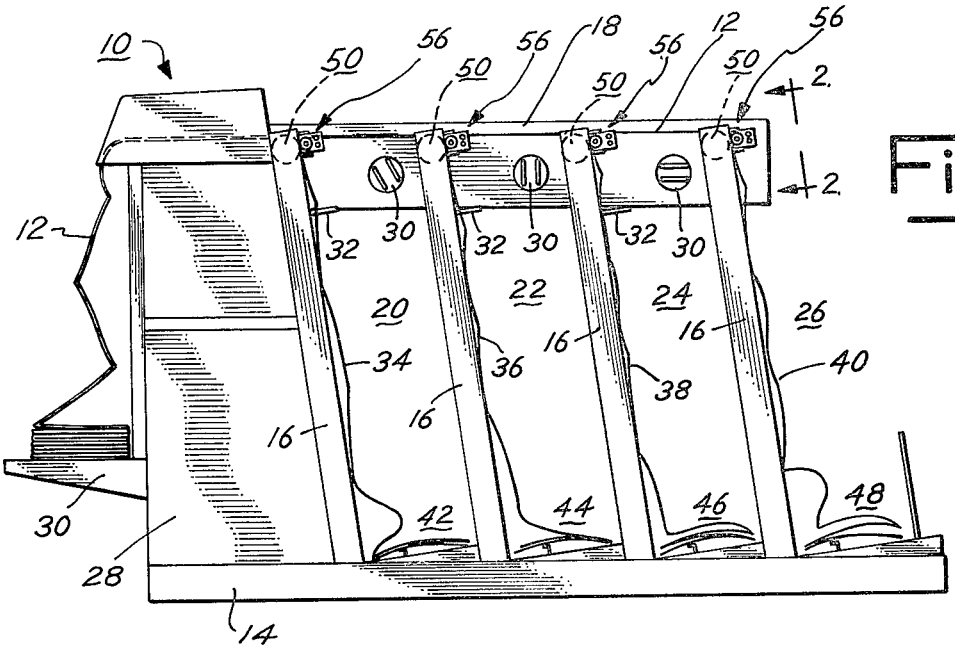
Fig. 1
Fig. 2
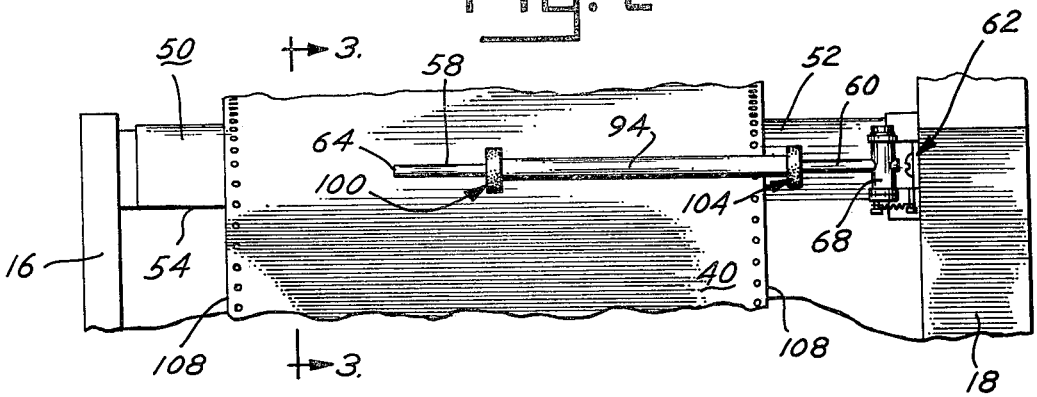
Fig. 3
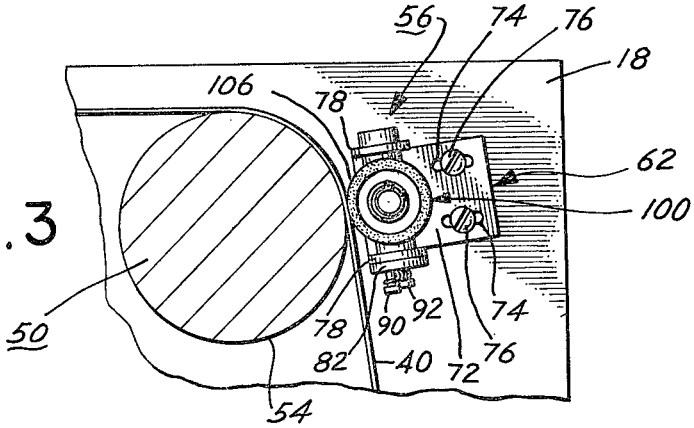

Fig. 4
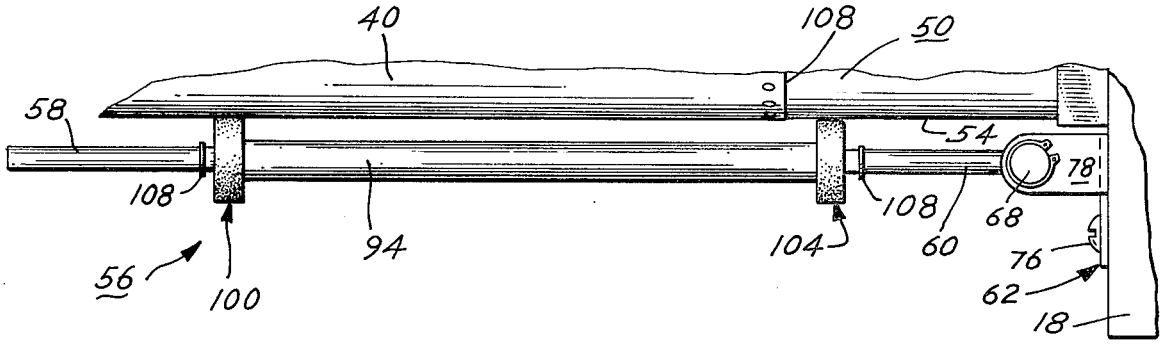
Fig. 5
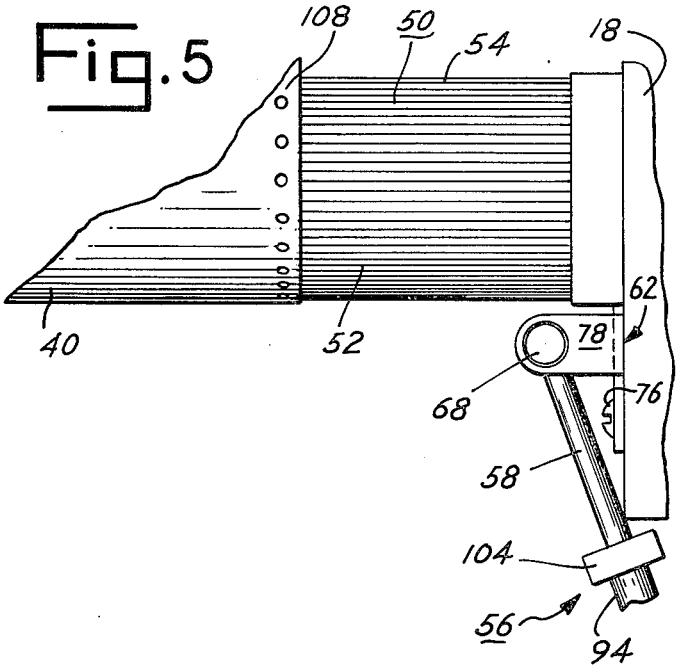
Fig. 7
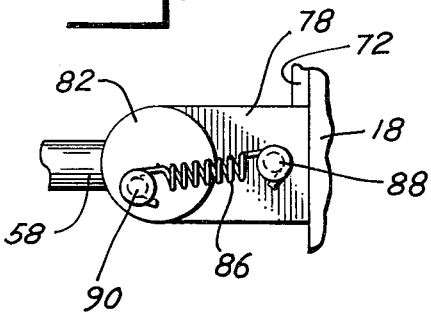
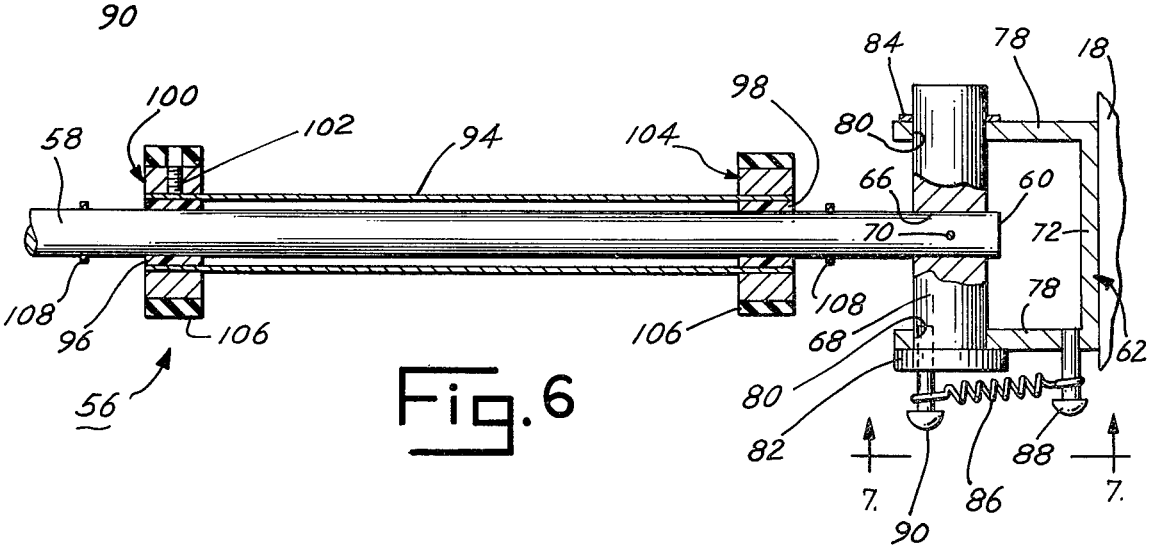
Fig. 6

Fig. 8
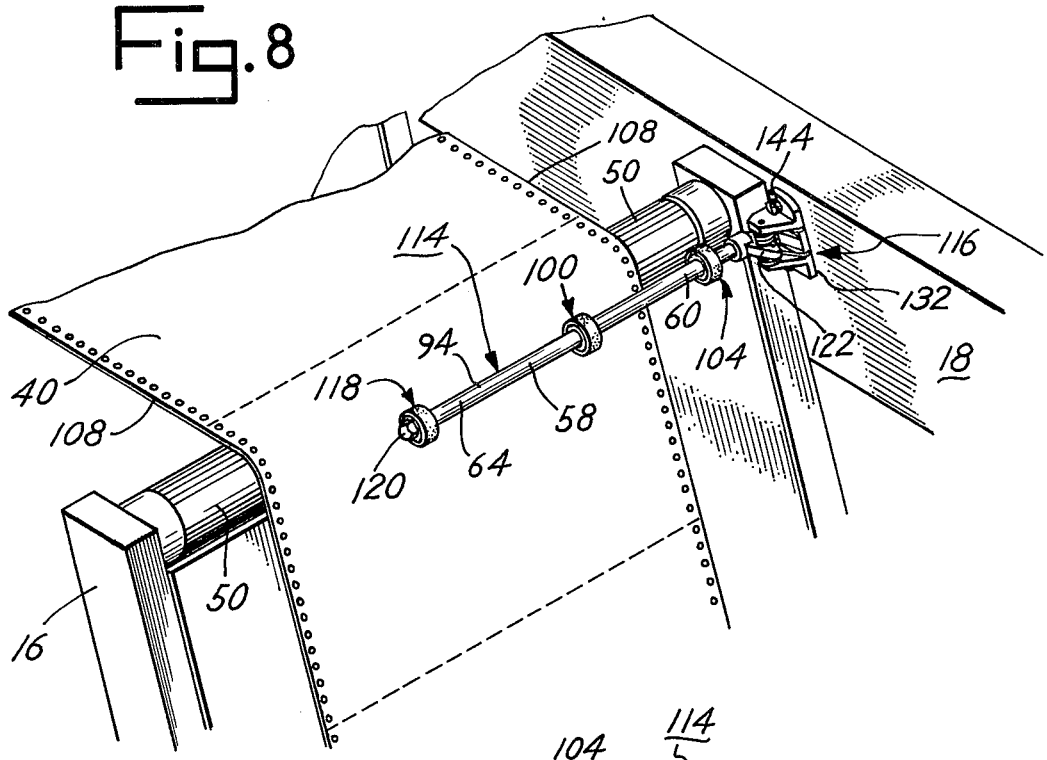
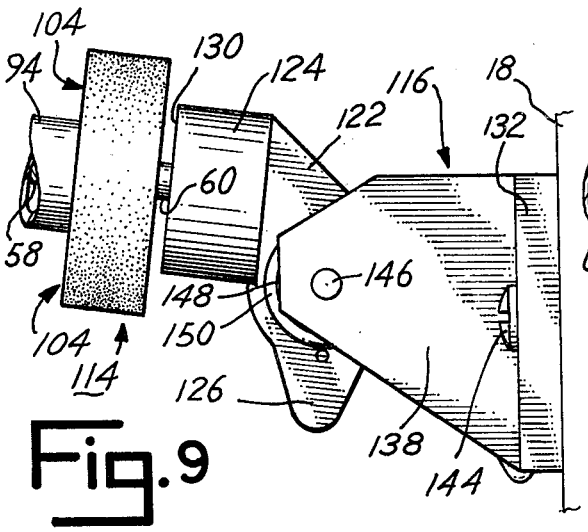
Fig. 9
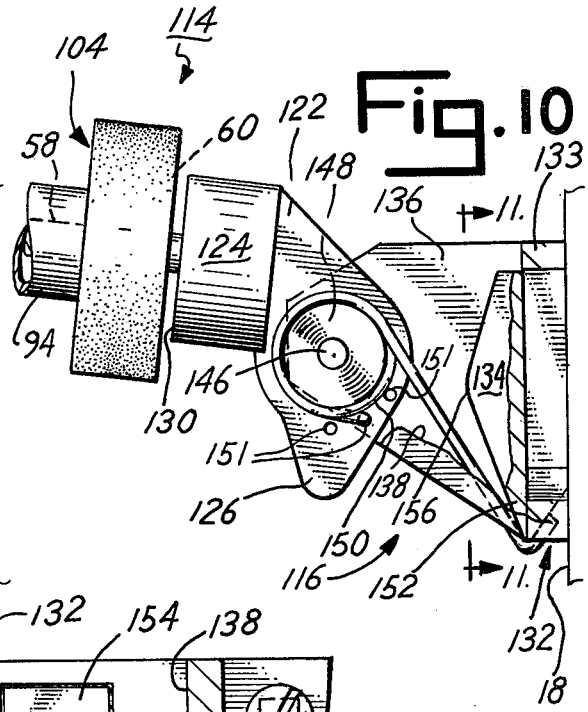
Fig. 10
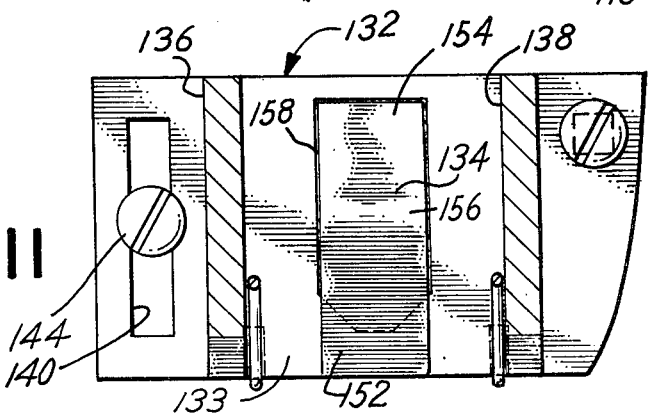
Fig. 11

DECOLLATING MACHINE AND APPARATUS

This is a continuation application of pending application Ser. No. 944,367, filed Sept. 21, 1978, now abandoned.

BACKGROUND AND SUMMARY OF THE INVENTION

The present invention relates to a machine and apparatus for decollating or separating parts of a multipart, carbonless, manifold continuous web business forms assembly, and more particularly, to an improved decollating machine and apparatus for separating the parts of a multipart, carbonless, manifold continuous web business forms assembly having "locks" incorporated therein that are utilized to hold the parts of the continuous business forms assembly in alignment when the continuous web business forms assembly is used on high speed printing devices.

Prior to the advent of carbonless paper, virtually all multi-part, manifold, continuous web business forms assemblies had continuous webs of carbon paper interleaved between the parts to effect transfer of information between the parts, and often had a plurality of integral perforated "locks" along their side margins to hold the parts in alignment when the business forms assemblies were used on high speed printing devices. The prior decollating machines were designed to remove and collect the carbon paper webs during the separation of the parts and in most prior machines, the removal and collection of the carbon paper web was used to facilitate separation of the parts of the business forms assembly.

More specifically, the prior decollating machines, and particularly those employing the so-called "waterfall" design, include a plurality of decollating stations arranged in series. Each decollating station has a rotating refold roller and a refold section, and functions to separate one part from the remaining parts of a continuous web business forms assembly. Generally, the business forms assembly is moved to and through a decollating station along a horizontal path adjacent to the refold roller. The part to be separated, the lowermost part in the business forms assembly, is directed down and around a portion of the refold roller and is then permitted to "fall" into the refold section positioned below the refold roller wherein the separated part is refolded again as a manifold pack. Generally, the adjacent carbon paper web, i.e. the carbon paper web disposed between the part to be separated and the part immediately above it, is also, with the separated part, directed down and around the refold roller and is then wound on a rotatable windup spindle positioned adjacent to the refold roller. The carbon paper web functions to forcibly direct the separated part around the refold roller.

In another prior decollating machine described in the Gill et al U.S. Pat. No. 3,857,557, the carbon paper web windup spindle was positioned upstream from the refold roller in decollating station, a second roller was biased against the refold roller, and the separated part was passed between the nip of the two rollers. In this machine, the carbon paper web, rather than the part to be separated, forms the lowermost part of the assembly as it approaches the decollating station. A transverse bar, disposed adjacent to the horizontal path of the business forms assembly and above the windup spindle, was utilized to assure separation of the carbon paper web and the separated part.

In recent years, carbonless, continuous web business forms assemblies have accounted for an ever-increasing share of the continuous web business forms assembly market. While such carbonless assemblies have many recognized advantages, vis-a-vis the carbon paper web assemblies, it has proved to be difficult to separate the parts of carbonless business forms assemblies on the prior decollating machines, particularly when one attempts to operate the machines at relatively high speeds, since there are obviously no carbon paper webs to assist in the separation. This difficulty is oftimes compounded because the parts of the carbonless business forms assemblies are frequently made from "weaker" paper, i.e. paper with more groundwood fiber content, than assemblies with interleaved carbon paper webs, and thus have a tendency to move around, relative to each other, on high speed printing devices. To overcome this tendency, the "locks" used with the carbonless assemblies have had to be strengthened, and this strengthening obviously increases the difficulty of separating the parts. In this regard, experience has shown that the satisfactory separation of the parts of carbonless business forms assemblies, with the required strengthened "locks", and the satisfactory refolding of the separated parts, cannot be consistently achieved on prior decollating machines unless the machines are run at relatively low speeds. If the machines are operated at even moderate speeds, the business form parts tend to remain fastened together and thus overshoot the refold section and become jumbled. This, of course, defeats the primary purpose for using decollating machines—the expeditious, troublefree separation of the parts with the refolding of the separated parts in individual manifold packs.

There is another problem with the above-described prior decollating machines even when the machines are utilized to separate business forms assemblies having carbon paper webs interleaved therein. Although the prior machines have been advertised as being capable of operation at relatively high top speeds, in practice, it has proved to be difficult to achieve sustained, effective operation at the rated top speeds, except under ideal conditions of humidity, static, strength of the "locks", paper weight, etc.

It is a principal object of our present invention to provide an improved machine and apparatus for decollating or separating the parts of a multi-part, carbonless, manifold, continuous web business forms assembly having integral "locks" incorporated therein. A related object of our present invention is to provide an improved decollating machine and apparatus that overcome the difficulties that the prior decollating machines had experienced in separating the parts of carbonless business forms assemblies and that in addition, permits decollating machines to be effectively operated at their top rated speeds on a regular and sustained basis. A further related object of the present invention is to provide an improved apparatus that may be relative inexpensively manufactured and expeditiously installed on existing decollating machines and that when installed, permits the decollating machines to achieve the effective separation of the parts of a multi-part carbonless business forms assemblies and the refolding of the separated parts at the rated top speed of the machines on a regular and sustained basis.

The preferred embodiment of an improved decollating machine of our present invention includes a frame which forms and delineates a plurality of decollating stations arranged in series, and means for moving a multi-part, carbonless, continuous web business forms assembly through the machine and past each of the decollating stations along a determined, generally horizontal path and at a pre-selected speed. Each of the decollating stations has a refold roller disposed adjacent and transverse to the horizontal, determined path of the business forms assembly and a refold section disposed below and downstream, with respect to the determined path, of the refold roller so as to receive the separated part of the business forms assembly. The refold roller is mounted for rotation so that the speed of its peripheral surface is slightly faster than the preselected speed. The part of the business forms assembly to be separated at a decollating station is the lowermost part in the assembly and is directed about and contacts a portion of the peripheral surface of the refold roller.

The improved apparatus for assisting in the decollation of the part to be separated from the business forms assembly includes a straight axle having one end mounted on a bracket for pivotal movement about a pivot axis which is perpendicular to the longitudinal axis of the axle and which permits the axle to be in either a first position or a second position. The bracket is mounted on the frame adjacent to the refold roller. A first wheel is mounted on the axle adjacent to the one end of the axle. In the preferred embodiment, a second wheel is mounted on the axle between the ends of the axle and a third wheel is mounted on the axle between the second wheel and the other end of the axle, although satisfactory performance may be achieved when only first and second wheels are utilized. All of the wheels are adapted to rotate about an axis coaxial with the longitudinal axis of the axle and all have relatively resilient outer peripheral surfaces. A tubular member is mounted on the axle so that its and the axle's longitudinal axes are coaxial, and serves to interconnect the wheels so that they rotate together on the axle.

When the axle is in the first position, the longitudinal axis of the axle is substantially parallel to the longitudinal axis of the refold roller, and the peripheral surface of the first wheel is in surface to surface contact with the peripheral surface of the refold roller so that the rotational speed or velocity of the peripheral surface of the first wheel, i.e. the velocity of the peripheral surface of the wheel in a direction perpendicular to a radius of the wheel, is substantially identical to the rotational speed or velocity of the peripheral surface of the refold roller which, as noted above, is slightly faster than the preselected speed of the business forms assembly. The peripheral surfaces of the second and third wheels are in surface to surface contact with the separated part of the business forms assembly as it passes about the refold roller. The diameter of the first wheel, which tends to drive the second and third wheels, is slightly smaller than the diameters of the second and third wheels so that the rotational speed or velocity of the peripheral surfaces of the driven second and third wheels are greater than that of the peripheral surface of the driven first wheel, i.e. greater than the pre-selected speed of the business forms assembly and particularly that of the separated part of the assembly. The difference between the speed of the second and third wheels and the speed of separated part of the business forms assembly results in the second and third wheels imparting an additional force to the separated part as it passes around the refold roller. This additional force aids in the separation of the separated part from the remainder of the business forms assembly by assisting in the "breakage" of the integral "locks" that are formed in the assembly to hold the parts of the assembly in alignment when it is used with high speed printing devices.

When the axle is in its second position, the longitudinal axis of the axle is disposed at an angle with respect to the longitudinal axis of the refold roller, and the wheels are not in contact with the refold roller and the separated part of the business forms assembly. Thus, in the second position, the improved apparatus does not assist in the separation of the business forms assembly. The bracket includes means which tend to bias the axle toward its first position and thus urges the first wheel and the second and third wheels against the refold roller and the separated part of the business forms assembly, respectively.

A decollating machine of our invention has been tested under actual conditions of expected use. These tests demonstrate that this improved machine is capable of expeditiously and satisfactorily decollating multipart, carbonless continuous business forms assemblies having integral "locks" incorporated therein. The machine may be operated at its rated top speed on a sustained basis without any loss of decollating effectiveness. The separated parts are neatly refolded in manifold packs in the refold sections. Tests have also demonstrated that the improved apparatus of our invention may be utilized with prior "waterfall" type machines of as to permit the modified machines to function to effectively decollate carbonless continuous business forms assemblies while the machines are being operated at their rated top speeds. The modification of these prior machines can be accomplished readily and relatively inexpensively since the cost of the improved apparatus is nominal relative to the cost of the machines and since the apparatus can be easily and quickly added to a machine.

Other advantages and benefits of the present invention will become apparent from the following description of the preferred embodiment of our invention which will be described in connection with the accompanying drawings.

DESCRIPTION OF THE DRAWINGS

FIG. 1 is a side, elevational view of an improved decollating machine embodying the principles of our present invention.

FIG. 2 is an enlarged, partial front view taken along the line 2—2 in FIG. 1.

FIG. 3 is a partial cross-sectional view taken along the line 3—3 in FIG. 2.

FIG. 4 is a top plan view of the refold roller and the improved apparatus of our present invention as shown in FIG. 2.

FIG. 5 is an enlarged, partial top plan view, similar to that in FIG. 4, showing the improved apparatus pivoted to a position angularly disposed from the position of the apparatus shown in FIG. 4.

FIG. 6 is an enlarged, partial cross-sectional, view of the improved apparatus of our present invention disposed in a position similar to that shown in FIG. 2 and showing the details of the structure and structure relationships embodied in the improved apparatus.

FIG. 7 is a side plan view taken along the line 7—7 in FIG. 6.

FIG. 8 is a perspective view of an improved decollating machine employing the preferred form of the improved apparatus of the present invention.

FIG. 9 is an enlarged, top plan view of the bracket, and adjacent end of the axle, shown in FIG. 8, with the axle being disposed in an intermediate position.

FIG. 10 is a partial, cross-sectional view of the bracket, as shown in FIG. 8, taken along a plane parallel and adjacent to the inside surface of upper projecting flange of the bracket and looking toward the other flange of the bracket, with the axle again being disposed in an intermediate position.

FIG. 11 is a partial, cross-sectional front elevational view, taken along the line 11—11 in FIG. 10.

Throughout the various figures of the drawings, same reference numerals will be used to designate the same parts. Moreover, when the terms "right", "left", "right end", "left end", "upper" and "lower" are used herein, it is to be understood that these terms shall have reference to the structure shown in the drawings as it would appear to a person viewing the drawings.

DESCRIPTION OF THE PREFERRED EMBODIMENT

Referring now to FIG. 1, an improved decollating machine embodying the principles of our present invention is shown generally at 10 and is adapted to be utilized to separate a carbonless, manifold, continuous web business forms assembly 12 having, in this instance, four individual and separate parts or components. Except as noted, the machine 10 is of a conventional design and construction, and includes a base 14 and four walls 16 that extend generally vertically upwardly and slightly to the left from the base. A transverse frame 18 extends across and interconnects the upper ends of the walls 16. The base 14, walls 16 and frame 18 delineate four decollating stations 20, 22, 24 and 26. A conventional motor and control housing 28 is mounted on the left end of the base 14. The housing 28 includes tractors, not shown, which are designed to provide for the positive feeding or driving of the business forms assembly 12, at various, pre-selected speeds, across the upper ends of the decollating stations 20–26 and along a generally horizontal path. The controls in the housing 28 permit the machine operator to cause the assembly 12 to be driven at any one of a variety of selectible speeds. The housing 14 also includes a leftward projecting side shelf 30 which is used to support the manifold packs of business forms assemblies to be decollated in the machine 10.

The decollating stations 20–24 each have a carbon paper rewind spindle 30 mounted on the frame 18 for rotation about its longitudinal axis and a carbon paper bar 32 mounted on the adjacent wall 16. The bar 32 acts as a tension guide for the carbon paper web separated at the decollating station and the spindle 30 is used to wind the carbon paper web in a roll when the machine 10 is used to decollate or separate business forms assemblies having continuous carbon paper webs interleaved therein. The rewind spindles 30 are rotated at a speed slightly faster than the pre-selected speed at which the business forms assembly 12 is being driven by the tractors in the housing 28.

At the decollating stations 20–26, the lowermost or bottom parts 34, 36, 38 and 40, respectively, of the horizontally moving, continuous web business forms assembly 12 are each, in turn, separated from the remainder of the assembly 12. The separated parts 34–40 are directed downwardly from the predetermined horizontal path of the business forms assembly 12 at their respective decollating station and thereafter fall or cascade into the refold sections 42, 44, 46 and 48, respectively, which are disposed adjacent to the base 14 and between the walls 16. The refold sections 42–48 are designed in a conventional manner so that the separated parts 34–40 will be refolded in manifold packs as a result of their falling or cascading down the right facing surfaces of the walls 16.

Except that the rightmost station 26 does not include a spindle 30 and bar 32, all of the decollating stations 20–26 are structurally and functionally identical. Consequently, only the decollating station 26 will be described in detail hereinafter.

As best shown in FIGS. 1–4, the decollating station 26 has a refold roller 50 which has its longitudinal axis disposed in the plane of the adjacent wall 16, which has one end rotatably mounted in the frame 30 and which has its other end rotatably mounted in an upper extension of the wall 16. The refold roller 50 is mounted so that it is rotated at a speed slightly faster than the speed at which the business forms assembly 12 is driven by the tractors and feed rolls in housing 28 and includes a plurality of longitudinal grooves 52 in its outer, peripheral surface 54. The part 40, which is to be decollated at the station 26, is directed around a portion of the peripheral surface 54 of the refold roller 50, and the grooves 54 aid in maintaining satisfactory contact between the roller 50 and the separated part 40. As illustrated in FIG. 2, the width of the business forms assembly 12 is less than the longitudinal length of the roller 50, and desirably, the assembly 12 is positioned inwardly of the extreme left and right ends of the roller 50.

One embodiment of the improved apparatus of our present invention is shown generally at 56 and includes a solid, straight axial or rod 58 having one end 60 supported for pivotal movement by a novel bracket 62 and having its other end 64 unsupported. More specifically, the end 60 of the axle 58 is secured in a cross bore 66 formed in a pin or bolt 68 by means of a set screw 70, as best shown in FIG. 6. The bracket 62 has a base 72 which includes a pair of slots 74 that are adapted to receive screws 76 used to secure the bracket 62 to the frame 18. The bracket 62 also has a pair of integral, side arms 78 which are formed adjacent to one end of the base 72 and which both project perpendicularly in the same direction from the plane of the base. The arms 78 have aligned apertures 80 therein to receive the pin 68, with the diameter of these apertures being slightly larger than the diameter of the pin 68 so that the pin can be easily pivoted in these apertures about its longitudinal axis. The pin 68 is prevented from sliding longitudinally, with respect to the apertures 80 by an integral flange 82 formed on one end of the pin and by a snap lock ring 84 disposed about the other end of the pin next to the adjacent arm 78.

The bracket 62 is mounted on the frame 18 so that the arms 78 are adjacent to the refold roller 50 and so that the axle 58 may be moved to a first position whereby the longitudinal axis of the axle 58 is substantially parallel to the longitudinal axis of the refold roller 50. As shown in FIG. 5, the axle 58 can also be pivoted to a second position wherein the longitudinal axis of the axle 58 is disposed at an angle with respect to the longitudinal axis of the refold roller 50 and wherein the other end 64 of the axle 58 is adjacent to the frame 18.

A coil compression spring 86 extends between the bracket 62 and pin 68 so as to act to bias the axle 58 to and through its first position. More specifically, and as illustrated in FIGS. 6 and 7, one end of the spring 86 is attached to a first screw 88 which is secured to the arm 78 adjacent to the flange 82 of the pin 68. The other end of the spring 86 is attached to a second screw 90 which is secured to the flange 82 of the pin 68 so that the spring biases the axle 58 to and through its first position, as shown in FIGS. 2 and 4.

A tube 94 is mounted on the axle 58. The diameter of the tube 94 is slightly larger than the diameter of the axle. Two annular spacers or bushings rings 96 and 98 are disposed adjacent to the ends of the tube 94 and between the tube and the axle so as to maintain the longitudinal axis of the tube coaxial with the longitudinal axis of the axle 58. The spacers 96 and 98 permit the tube 94 to rotate, relative to the axle, about its longitudinal axis and are made from a material that offers only minimal frictional resistance to such relative rotation.

As best illustrated in FIGS. 4 and 6, a wheel 100 is mounted on the left end of the tube 94, and is secured thereon and prevented from rotating relative to the tube by a set screw 102. A wheel 104 is mounted on the right end of the tube 94 and is similarly secured to the tube and prevented from rotating relative to the tube by a similar set screw, not shown. The outer peripheral surface 106 of the wheels 100 and 104 are made from a relatively resilient material so as to improve the ability of the wheels to engage relatively moving surfaces as hereinafter explained. Two snap lock rings 108 are disposed on the axle 58 adjacent to the ends of the tube 94 and are employed to limit the relative longitudinal movement of the tube 94 with respect to the axle 58.

The diameters of the peripheral surfaces 106 of the wheels 100 and 104 have been selected so that when the axle 58 is in its first position, i.e. in the position shown in FIGS. 2–3, the peripheral surfaces 106 of the wheels 100 and 104 are in surface to surface contact with the outer peripheral surface of the refold roller 50. More specifically, the wheel 104, and the tube 94 are positioned on the axle 58 such that the peripheral surface 106 of the wheel 104 is in direct surface to surface contact with the peripheral surface 54 of the refold roller 50. The wheel 100 is positioned, via-a-vis the refold roller 50 and the portion of the separated part 40 which is passed about and is in contact with the refold roller, so that its peripheral surface 106 is in direct surface to surface contact with the portion of the separated part 40 as it passes around the roller 50. The bias force exerted by the spring 86 helps to maintain the surface to surface contact between the wheels 100 and 104 and the separated part 40 and the refold rollers 50, respectively.

As best shown in FIG. 2, the wheel 100 preferably contacts the separated part 40 approximately midway between its side marginal edges 108. As illustrated in FIG. 3, the "points of contact" between the wheels 100 and 104 and the separated part 40 and the refold roller 50, respectively, are located below a horizontal plane which is tangent to the top of the refold roller 50, i.e. tangent to the plane of the predetermined, horizontal path of the forms assembly 12, and above a horizontal plane that includes the central longitudinal axis of the refold roller 50. The "points of contact" between the driven wheel 100 and the separated part 40 assure that the separated part will be properly directed downwardly toward the refold section 48.

It has been found that greatly improved performance, in terms of the separation of the parts 34–40 from the remainder of the business forms assembly 12, can be achieved when the diameter of the wheel 104 is smaller than the diameter of the wheel 100. As noted above, the rotational speed or velocity of the peripheral surface 106 of the wheel 104 is substantially equal to that of the peripheral surface 54 of the refold roller 50. [The term rotational speed or velocity as used herein refers, for example, to the speed or velocity of a point on the peripheral surface 106 in a direction perpendicular to a radius of the wheel 104.] Since the tube 94 interconnects the wheels 100 and 104, they rotate together, i.e. have the same angular velocity. Nevertheless, because of its increased diameter, the wheel 100 has a larger rotational speed or velocity than that of the wheel 104 and thus than that of the separated part 40. As a result of its overspeed, the wheel 100 imparts an additional force to the separated part 40 as it passes around the refold roller 50. This additional force assists in the breaking of integral "locks" which are utilized in the business forms assembly 12 to hold the various parts 34–40 in alignment when the assembly 12 is used on high speed printing devices, such as, for example, a high speed, impact printer.

Experience with prototype devices has suggested that when the diameter of the wheel 104 is between 5–20% smaller than the diameter of the wheel 100, the decollating machine 10 may be operated at its rated top speeds for sustained periods of time and still affect an effective and satisfactory separation of the parts 34–40 and the refolding of these separated parts, in manifold packs, in the refold sections 42–48. Such experience has also suggested that when the diameter of the wheel is 15% smaller, than the diameter of the wheel 100, superior results have been achieved in these prototype devices.

A second, preferred embodiment of the improved apparatus of our invention is shown generally at 114 in FIGS. 8–11. The apparatus 114 is structurally and functionally substantially identical to apparatus 50 except to the extent noted hereinafter.

The end 60 of the axle 58 employed with apparatus 114 is supported for pivotal movement by a novel bracket 116 which will be described in detail hereinafter. However, the axle 58 of the apparatus 114 could be supported by bracket 62, just as apparatus 56 could be supported by bracket 116.

The principal difference between the apparatus 56 and the apparatus 114 is that the latter includes a third wheel 118 in addition to the first and second wheels 104 and 100. The wheel 118 is structurally identical to the wheels 100 and 104. In the apparatus 114, the axle 58 and the tube 94 may be of a slightly longer length than the axle 58 in the apparatus 56, and an "acorn" nut 120 may be connected with the end 64 of the axle to hold the axle and tube in their proper, assembled relationship.

The third wheel 118, like wheels 100 and 104, is mounted on the tube 94 so as to prohibit relative movement between the wheel 118 and tube and so as to permit all three wheels to rotate together. The wheel 118 is disposed adjacent to the end 64 of the axle 58, with the second wheel 100 being disposed between the third wheel 118 and the first wheel 104. Like in the apparatus 56, the "points of contact" between the wheels 100, 104 and 118 and the separated part 40 and the refold roller 50 are located below a horizontal plane which is tangent to the top of the refold roller 50 and above a horizontal plane that includes the central longitudinal axis of the refold roller 50. The length of the axle 58, and tube 94 and the disposition of the second and third wheels 100 and 118 along the tube 94 are selected so that the "points of contact" between the peripheral surfaces of the wheels 100 and 118 and the separated part 40 are generally one-fourth and three-fourths of the way between the side marginal edges 108 of the part 40.

The utilization of three wheels (i.e. two driven wheels and one drive wheel) instead of two wheels permits the apparatus 114 to be used with forms having a greater variety of widths and with webs that have been cut into two longitudinal webs by a prior, mid-form slitting operation. Moreover, tests have shown that minor eccentricities in the surface of the refold rollers 50 can cause a momentary loss of "sheet pull", that such a momentary loss may occasionally initiate a decollating malfunction, and that the use of the two driven wheels 100 and 199 minimizes this potential problem, as well as increasing the "pulling force" applied to the web by the apparatus 118. The utilization of two spaced apart, driven wheels also reduces "sheet flutter", especially on relatively wide forms.

As best illustrated in FIGS. 9–11, the bracket 116 includes a pivotable, molded pastic member 122 having a generally cylindrical portion 124, a first projecting finger portion 126. The cylindrical portion 124 has a generally circular, outwardly facing surface 130, and the end 60 of the axle 58 is secured to the center of the surface 130 so that the axle 58 projects perpendicularly outwardly therefrom. The first wheel 104 is mounted on the tube 94 so that it is adjacent to the surface 130.

The bracket 116 also includes a molded plastic support plate 132 having a generally rectangular base 133, a centrally disposed, spring finger portion 134 and two spaced apart flanges 136 and 138 that project outwardly from one side of the base 133. Two apertures 140 and 142 are formed in the base 133, are disposed between the flanges 136 and 138 and the side edges of the base and are adapted to receive screws 144 that are utilized to mount the support plate 132 on the frame 18.

A pin 146 extends between the distal, projecting ends of the flanges 136 and 138, and through an aperture in the member 122 so that the member 122 may freely pivot about the axis of the pin in a plane generally perpendicular to the pin axis and generally parallel to the flanges. Spacer rings 148 are mounted on the pin 146 between the member 122 and the flanges 136 and 138. The spacer rings 148 may be separate parts or may be integrally molded with the member 122, and may preferably be formed as an integral part of the member 122. A coil compression spring 150 is mounted about each of the spacer rings 148 so that the longitudinal axes of the springs are generally parallel to the axis of the pin 146. One end of each of the springs 150 is secured to the support plate 132 and the other ends of the springs are secured to the member 122. The springs 150 are arranged so that they bias the member 122 in a clockwise direction, as shown in FIGS. 9 and 10, and so that the wheel 104 and the wheels 100 and 118 will be urged against and into contact with the peripheral surface of the refold roller 50 and the separated part 40, respectively, as shown in FIG. 8. The advantage of using the coil compression springs 150 is that it permits facile adjustment of the biasing force exerting by the springs on the member 122. In this regard, the member 122 may include a series of spaced holes 151 which are formed in the surfaces of the member 122 that face the flanges 136 and 138 and which are disposed along an arc about the axes of the pin 146. These holes 151 are adapted to receive the other ends of the springs 150, and the bias exerted by the springs may be adjusted by the simple expedient of changing the holes in which the other ends of the springs 150 are disposed.

As best illustrated in FIGS. 10 and 11, the spring finger portion 134 of the bracket 116 is disposed between the plane of the base 133 and the pin 146 and between the flanges 136 and 138. The one end 152 of the finger portion 134 is integrally joined with the base 133. The remaining part 154 of the finger portion 134 includes a smoothly curved intermediate portion 156 that extends toward the pin 146. The part 154 overlies a central aperture 158 which is formed in the base 133 and which is dimensioned such that it is slightly wider and longer than the depending part 154 thereby permitting the part 154 to be moved within and relative to the aperture.

The spring finger portion 134 is normally positioned, as shown in FIG. 10, in a plane generally parallel to the plane of the base 133, but may be forced to pivotably move, about its end 152, from this normal position although the finger portion 134 inherently resists such movement. The finger portion 126 of the member 122 is dimensioned such that it will contact, and with the application of a relatively small force, move pass the intermediate portion 156 of the finger portion 134 when the apparatus 114 is manually pivoted, about the pin 146, from its first, "running" position, as shown in FIG. 8, to its second, "storage" position wherein the apparatus 114 is disposed adjacent to the frame 18. The apparatus 114 is retained in its second, "storage" position as a result of contact between the finger portion 134 and the intermediate portion 156. The apparatus 114 can be returned to its first, "running" position by forcing the finger portion 126 to move past the intermediate portion 156, i.e. move the finger portion 134 out of its way, so that the apparatus can pivot about the pin 146.

Experience has shown that when the diameter of the wheel 104 is between 5–20% smaller than the diameter of the wheel 100, and when the diameter of the wheel 100 is between 5–20% smaller than the diameter of the wheel 118, the decollating machine 10 may be operated at its rated top speeds for sustained periods of time and still affect an effective and satisfactory separation of the parts 34–40 and the refolding of these separated parts, in manifold packs, in the refold sections 42–48.

It has also been found that a decollating machine embodying the improved apparatus 56 or the improved apparatus 114 overcome another serious problem with respect to effective and efficient separation of multi-part, carbonless business forms assemblies. More specifically, the use of the wheel 100 or the wheels 100 and 118 to drive the separated parts downwardly, with respect to the refold roller 50 from the horizontal predetermined path of the assembly, seems to eliminate much of the problem of static build-up which has heretofore oftimes causes the separated parts not to be folded in the desired manifold fashion in the refold section.

In operation of the machine 10, a business forms assembly 12 is placed on the shelf 24 and is brought through the tractor in the motor and control housing 28. The assembly 12 can be any conventional multi-part, carbonless continuous web business forms assembly although as noted above, the machine 10, as illustrated in FIG. 1, cannot be used to decollate an assembly having more than four individual parts. (In this regard, if the machine 10 included additional decollating stations, then naturally the machine could be used to decollate form assemblies having more than four parts.) The leading edge of the assembly 12 is manually drawn along a horizontal, predetermined path which is substantially tangent to the tops of the refold rollers 50 in each of the decollating stations 20–26. At each of the decollating stations, starting with station 20 and continuing in series through station 26, the leading edge of the lowermost part of the assembly 12 is separated manually from the assembly and is passed about the refold roller 50 at the station and between the refold roller and the wheel 100 or the wheels 100 and 118. When the assembly 12 has been positioned as illustrated in FIG. 1, the machine 10 is started in a conventional manner, and as noted above, it can be run at its rated top speed until the entire form assembly 12 has been decollated or separated. When it is desired to decollate or separate a multi-part continuous web business forms assembly without utilizing the apparatus 56 or 114, e.g. when the forms assembly has carbon paper webs interleaved therein, each of the axles 58 can be moved from their first "running" positions to their second, "storage" positions wherein the apparatus 56 or the apparatus 114 is completely out of the way and does not hinder the operation of the machine 12 as it decollates or separates the "carbon interleaved" assembly.

It has also been found however, that the improved apparatus 56 or 114 of the present invention may be used with decollating machines to improve the separation of the parts of a multi-part, "carbon interleaved" forms assemblies, so as to permit the machine to be operated at increased, relatively higher speeds. A similar improvement in the separation of "carbon interleaved" forms assemblies is believed to be achievable when the improved apparatus 56 or 114 is used with the Gill et al type machine. In this regard, it should be noted that these improved results are obtainable because the improved apparatus both directs and drives, i.e. "powers", the separated part around and down from the refold roller.

As will be apparent to those having skill in this art, the machine 10 and the apparatus 56 or 114 could be modified without affecting the overall operation or advantages of our invention. For example, the axle 58 could be mounted on the frame 30 by means other than of the brackets 52 or 116 and other means could be used to pivot the end 60 of the axle 58 between its first and second positions. Similarly, other means could be used to bias the axle to and through its first position, i.e. bias the wheels 100, 104 and/or 118 against the separated part 40 and the refold roller 50. The wheels 100, 104 and 118 could also be made without their relatively resilient surfaces 106, although it has been found, in practice, that the use of such resilient surfaces 106 helps to assure that adequate surface to surface contact is achieved between the surfaces 106 and the surfaces of the separated parts 34–40 and the refold rollers 50. In selecting radial dimensions for the wheels, it is believed that optimum results will be obtained, from a theoretical standpoint, by making the outer peripheral wheel surfaces conform to sections of a common, conical surface. However in practice, the outer peripheral wheel surfaces should all be generally cylindrically in shape in order to maximize contact between the wheel surfaces and the separated part and the refold roller surface. In apparatus 114, the wheels 100 and 118 could have the same diameter but it is believed in this situation, that a "universal" type joint may have to be included in the axle between the wheels or the surfaces 106 of the wheels would have to be made from a very resilient material. Lastly, the wheel 104 could be eliminated in the apparatus 56 or 114 in the situation where the driven wheels 100 and/or 118 are rotated by other independent driving means.

Thus, since our invention, as disclosed herein, may be embodied in other specific forms without departing from the spirit or central characteristics thereof, the preferred embodiments described hereinabove are therefore to be considered in all respects as the illustrative and not restrictive, the scope of our invention being indicated by the appended claims, rather than by the foregoing description, and all changes which come within the meaning and range of equivalency of the claims are therefore intended to be embraced therein.

We claim:

1. An improved machine for decollating or separating parts of a multi-part, carbonless, manifold, continuous web business forms assembly having "locks" incorporated therein that are utilized to hold the parts of the continuous web business forms assembly in alignment when the continuous web business forms assembly is used with forms handling equipment, the improved machine comprising:

frame means for defining a plurality of decollating stations that are arranged in series;

means for moving the continuous web business forms assembly with respect to and past each of the decollating stations along a determined path and at a pre-selected speed;

each of the decollating stations comprising: a roller which is rotatably mounted on the frame means, which is disposed substantially adjacent and transverse to the determined path, and which is arranged so that the part of the continuous web business forms assembly to be separated at the decollating station is directed about and contacts a portion of the peripheral surface of the roller; means for rotating the roller so that the rotational speed of the peripheral surface of the roller is slightly greater than the pre-selected speed; a refolding section disposed adjacent to and downstream of the roller, with respect to the determined path, for receiving the separated part of the continuous web business forms assembly; and means for assisting the separation of the separated part of the continuous web business forms assembly, the separation assist means being mounted on the frame means and including: an axle having one end supported on the frame means so that at least a portion of the longitudinal axis of the axle is substantially adjacent and transverse to the determined path; a first wheel rotatably mounted on the axle so that its peripheral surface is in surface to surface contact with the peripheral surface of the roller and so that rotation of the roller causes corresponding rotation of the first wheel; a second wheel rotatably mounted on the axle so that its peripheral surface is in surface to surface contact with the separated part of the continuous web business forms assembly as the separated part passes around and contacts the peripheral surface of the roller; and means for connecting the first and second wheels so that the wheels rotate together, with the first wheel having a smaller diameter than the second wheel so that the rotational speed of the peripheral surface of the second wheel is greater than the preselected speed of the separated part of the continuous web business forms assembly as the separated part passes between the roller and the second wheel and so that the second wheel imparts a separating force to the separated parts, as it passes between the roller and the second wheel, that assists in breaking the "locks" in the continuous web business forms assembly.

2. The improved machine described in claim 1 which includes means for biasing the first wheel and the second wheel against the peripheral surface of the roller and the separated part of the continuous web business forms assembly, respectively.

3. The improved machine described in claim 1 wherein the peripheral surface of the first and second wheels are relatively resilient so as to facilitate the maintenance of surface to surface contact with the roller and the separated part, respectively; and wherein the peripheral surface of the roller has a plurality of longitudinal, closely spaced grooves therein.

4. The improved machine described in claim 1 wherein the separation assist means is movable from the position in which the first and second wheels are in surface to surface contact with the roller and the separated part of the continuous web business forms assembly, respectively, and a second position in which the first and second wheels are no longer in surface to surface contact with the roller and the separated part.

5. The improved machine described in claim 4 wherein the longitudinal axis of the portion of the axle is substantially parallel with the longitudinal axis of the roller when the axle is in its first position; wherein the one end of the axle is mounted for pivotal movement about pivot axis perpendicular to the longitudinal axis of the axle so that the axle can be moved about the pivot axis between the first position and the second position in which the longitudinal axis of the portion of the axle is disposed at an angle with respect to the longitudinal axis of the roller.

6. The improved machine described in claim 1, wherein the means for connecting the first and second wheels is a tubular member which is mounted about the axle so that the longitudinal axes of the axle and the tubular member are coaxial; and wherein the longitudinal axis of the axle is straight.

7. The improved machine described in claim 1 wherein the determined path is substantially horizontal; wherein the longitudinal axis of the axle is disposed beneath the determined path; and wherein an acute angle is defined between the vertical plane that includes the longitudinal axis of the roller and a plane that includes the longitudinal axes of the roller and the axle.

8. The improved machine described in claim 1 wherein the separation assist means includes a third wheel that is mounted on the axle between the other end of the axle, and the second wheel, that has its peripheral surface in surface to surface contact with the separated part of the continuous web business forms assembly as the separated part passes around and contacts the peripheral surface of the roller, and that is connected with the connecting means so that the first, second and third wheels rotate together, with the diameter of the second wheel being smaller than the diameter of the third wheel so that the rotational speed of the peripheral surface of the third wheel is greater than the preselected speed of the separated part of the continuous web business forms assembly as the separated part passes between the roller and the third wheel and so that the third wheel imparts a separating force to the separated part, as it passes between the roller and the third wheel, that assist in breaking the "locks" in the continuous web business forms assembly.

9. The improved machine described in claim 8 which includes means for biasing the first wheel and the second and third wheels against the peripheral surface of the roller and the separated part of the continuous web business forms assembly, respectively.

10. The improved machine described in claim 8 wherein the peripheral surface of the first, second and third wheels are relatively resilient so as to facilitate the maintenance of surface to surface contact with the roller and the separated part; and wherein the peripheral surface of the roller has a plurality of longitudinal, closely spaced grooves therein.

11. The improved machine described in claim 8 wherein the separation assist means is movable from the position in which the first wheel and the second the third wheels are in surface to surface contact with the roller and the separated part of the continuous web business forms assembly, respectively, and a second position in which the first wheel and the second and third wheels are no longer in surface to surface contact with the roller and the separated part.

12. The improved machine described in claim 11 wherein the longitudinal axis of the portion of the axle is substantially parallel with the longitudinal axis of the roller when the axle is in its first position; wherein the one end of the axle is mounted for pivotal movement about pivot axis perpendicular to the longitudinal axis of the axle so that the axle can be moved about the pivot axis between the first position and the second position in which the longitudinal axis of the portion of the axle is disposed at an angle with respect to the longitudinal axis of the roller.

13. The improved machine described in claim 8, wherein the means for connecting the first, second and third wheels is a tubular member which is mounted about the axle so that the longitudinal axes of the axle and the tubular member are coaxial; and wherein the longitudinal axis of the axle is straight.

14. In a decollating machine including: a frame which defines a plurality of decollating stations arranged in series; means for moving the continuous web business forms assembly with respect to and past each of the decollating stations along a determined path and at a pre-selected speed; each decollating stations having a roller which is rotatably mounted on the frame, which is disposed substantially adjacent and transverse to the determined path, and which is arranged so that the part of the continuous web business forms assembly being separated at the decollating station is directed about and contacts a portion of the peripheral surface of the roller; means for rotating the roller so that the rotational speed of the peripheral surface of the roller is substantially equal to the pre-selected speed; and a refolding section disposed adjacent to and downstream of the roller with respect to the determined path, for receiving the separated part of the continuous web business forms assembly; an improved assembly for use with each of the decollating stations for assisting in separating a part from a multi-part carbonless, manifold, continuous web business forms assembly having "locks" to hold the parts of the continuous web business forms assembly in alignment when the continuous web business forms assembly is used with forms handling equipment, the improved apparatus comprising:

an axle having a first end and a second end;

means adapted for connecting the first end of the axle with the frame adjacent to the roller so that when the axle is connected with the frame, the axle is disposed in a first position wherein at least a portion of the longitudinal axis of the axle is substantially adjacent and transverse to the determined path;

a first wheel having a peripheral surface and being rotatably mounted on the axle adjacent to the first end of the axle and adapted so that when the axle is connected with the frame, its peripheral surface is disposed in surface to surface contact with the peripheral surface of the roller;

a second wheel having a peripheral surface and being rotatably mounted on the axle between the first wheel and the second end of the axle and adapted so that when the axle is connected with the frame, its peripheral surface is in surface to surface contact with the portion of the separated part of the continuous web business forms assembly as it contacts the portion of the peripheral surface of the roller, and means for connecting the first wheel and the second wheel so that the wheels rotate together, with the first wheel having a smaller diameter than the second wheel so that the rotational speed of the peripheral surface of the second wheel is greater than the pre-selected speed when the axle is connected with the frame.

15. The improved apparatus described in claim 14 wherein the first end of the axle is mounted for pivotal movement about a pivot axis perpendicular to the longitudinal axis of the axle so that the axle can be pivoted about its first end between the first position and a second position wherein the peripheral surfaces of the first wheel and the second wheel are no longer adapted to be in surface to surface contact with the peripheral surface of the roller and the separated part of the continuous web business forms assembly, respectively.

16. The improved apparatus described in claim 15 wherein the apparatus includes means for biasing the axle to its first position.

17. The improved apparatus described in claim 16 wherein means adapted for connecting the first end of the axle with a portion of the frame is a bracket; and wherein a coil compression spring is connected between the bracket and the first end of the axle so as to bias the axle to its first position.

18. The improved apparatus described in claim 14 wherein the means for connecting the first and second wheels is a tubular member mounted on and about the axle so that the longitudinal axes of the tubular member and the axle are coaxial.

19. The improved apparatus described in claim 14 wherein the peripheral surfaces of the first and second wheels are relatively resilient; and wherein the longitudinal axis of the axle is straight.

20. The improved apparatus described in claim 14 wherein a third wheel is mounted on the axle between the second end of the axle and the second wheel, has its peripheral surface in surface to surface contact with the portion of the separated part of the continuous web business forms assembly as it contacts the portion of the peripheral surface of the roller, and is connected with the connecting means so that the first, second and third wheels rotate together, with the diameter of the second wheel being smaller than the diameter of the third wheel so that the rotational speed of the peripheral surface of the third wheel is greater than the preselected speed.

21. The improved apparatus described in claim 20 wherein the first end of the axle is mounted for pivotal movement about a pivot axis perpendicular to the longitudinal axis of the axle so that the axle can be pivoted about its first end between the first position and a second position wherein the peripheral surfaces of the first wheel and the second and third wheels are no longer adapted to be in surface to surface contact with the peripheral surface of the roller and the separated part of the continous web business forms assembly, respectively.

22. The improved apparatus described in claim 21 wherein the apparatus includes means for biasing the axle to its first position.

23. The improved apparatus described in claim 22 wherein means adapted for connecting the first end of the axle with a portion of the frame is a bracket; and wherein a coil compression spring is connected between the bracket and the first end of the axle so as to bias the axle to its first position.

24. The improved apparatus described in claim 20 wherein the means for connecting the first, second and third wheels is a tubular member mounted on and about the axle so that the longitudinal axes of the tubular member and the axle are coaxial.

25. The improved apparatus described in claim 20 wherein the peripheral surfaces of the first and second wheels are relatively resilient; and wherein the longitudinal axis of the axle is straight.

26. Improved apparatus adapted for use with a roller: which constitutes a portion of a decollating station in a machine for decollating or separating a part from a multi-part, carbonless, manifold continuous web business forms assembly that includes "locks" utilized to hold the parts of the continous web business forms assembly in alignment when the continuous web business forms assembly is used with high speed printing devices; which is rotatable about its longitudinal axis at a pre-selected speed; and which is adapted to have the separated part of the continuous web business forms assembly be directed about and be in contact with a first portion of its peripheral surface, the improved apparatus comprising:

an axle having a longitudinal axis, a first end and a second end;

means adapted for mounting the first end of the axle on the machine and adapted for securing the axle adjacent to the roller;

a first wheel having a peripheral surface and being mounted on the axle adjacent to the first end of the axle for rotation about the longitudinal axis of the axle, the first wheel being adapted to be disposed adjacent to and in contact with a portion of the peripheral surface of the roller other than the first portion of the peripheral surface of the roller when the apparatus is mounted on the machine;

a second wheel having a peripheral surface and being mounted on the axle between the first wheel and the second end of the axle for rotation about the longitudinal axis of the axle, the second wheel being adapted to be disposed adjacent to the first portion of the peripheral surface of the roller and to be in contact with the separated part of the continuous web business forms assembly as the separated part is directed about the first portion of the peripheral surface of the roller when the apparatus is mounted on the machine, with the second wheel having a larger diameter than the first wheel; and means for connecting the first wheel and the second wheel so that the wheels rotate together and so that the rotational speed of the peripheral surface of the second wheel is greater than the rotational speed of the peripheral surface of the first wheel.

27. The improved apparatus described in claim 26 wherein the means connected with the first end of the axle is a bracket; wherein the first end of the axle is mounted on the bracket for pivotal movement about a pivot axis perpendicular to the longitudinal axis of the axle between a first position and a second position spaced angularly from the first position.

28. The improved apparatus described in claim 27 wherein a coil compression spring is connected between the bracket and the first end of the axle so as to bias the axle to its first position.

29. The improved apparatus described in claim 26 wherein the means for connecting the first and second wheels is a tubular member which is mounted on and about the axle so that the longitudinal axes of the tubular member and the axle are coaxial.

30. The improved apparatus described in claim 26 wherein the peripheral surfaces of the first and second wheels are relatively resilient; and wherein the longitudinal axis of the axle is straight.

31. The improved apparatus described in claim 26 which includes a third wheel that is mounted on the axle between the second end of the axle and the second wheel, that is adapted to be disposed adjacent to the first portion of the peripheral surface of the roller when the apparatus is mounted on the machine, and that is connected with the connecting means so that the first, second and third wheels rotate together, with the diameter of the third wheel being greater than the diameter of the second wheel so that the rotational speed of the peripheral surface of the third wheel is greater than the rotational speed of the peripheral surface of the first wheel.

32. The improved apparatus described in claim 31 wherein the means connected with the first end of the axle is a bracket; wherein the first end of the axle is mounted on the bracket for pivotal movement about a pivot axis perpendicular to the longitudinal axis of the axle between a first position and a second position spaced angularly from the first position.

33. The improved apparatus described in claim 32 wherein a coil compression spring is connected between the bracket and the first end of the axle so as to bias the axle to its first position.

34. The improved apparatus described in claim 31 wherein the means for connecting the first, second and third wheels is a tubular member which is mounted on and about the axle so that the longitudinal axes of the tubular member and the axle are coaxial.

35. The improved apparatus described in claim 31 wherein the peripheral surfaces of the first, second and third wheels are relatively resilient; and wherein the longitudinal axis of the axle is straight.

* * * * *